US010178907B2

(12) United States Patent
Hohlbein

(10) Patent No.: US 10,178,907 B2
(45) Date of Patent: Jan. 15, 2019

(54) ORAL CARE IMPLEMENT

(71) Applicant: COLGATE-PALMOLIVE COMPANY, New York, NY (US)

(72) Inventor: Douglas Hohlbein, Hopewell, NJ (US)

(73) Assignee: Colgate-Palmolive Company, New York, NY (US)

( * ) Notice: Subject to any disclaimer, the term of this patent is extended or adjusted under 35 U.S.C. 154(b) by 88 days.

(21) Appl. No.: 14/653,869

(22) PCT Filed: Dec. 20, 2012

(86) PCT No.: PCT/US2012/070760
§ 371 (c)(1),
(2) Date: Jun. 19, 2015

(87) PCT Pub. No.: WO2014/098853
PCT Pub. Date: Jun. 26, 2014

(65) Prior Publication Data

US 2015/0327665 A1 Nov. 19, 2015

(51) Int. Cl.

| | |
|---|---|
| ***A46B 9/04*** | (2006.01) |
| ***A46B 9/02*** | (2006.01) |
| *A46B 15/00* | (2006.01) |
| *A46B 3/06* | (2006.01) |
| *A46B 9/06* | (2006.01) |

(52) U.S. Cl.
CPC ..... *A46B 9/04* (2013.01); *A46B 9/025* (2013.01); *A46B 3/06* (2013.01); *A46B 9/06* (2013.01); *A46B 15/0081* (2013.01); *A46B 2200/1066* (2013.01)

(58) Field of Classification Search
CPC ..... A46B 3/06; A46B 9/025; A46B 9/04
USPC ..... 15/191.1–193, 195, 167.1
See application file for complete search history.

(56) References Cited

U.S. PATENT DOCUMENTS

| | | | | |
|---|---|---|---|---|
| 1,901,230 A | | 4/1932 | Duey | |
| 1,897,365 A | | 2/1933 | Duey | |
| 2,161,349 A | * | 6/1939 | Hadden | A46B 9/04 15/106 |
| 2,303,667 A | | 12/1942 | Taborski | |
| 2,305,461 A | | 12/1942 | Spyra | |

(Continued)

FOREIGN PATENT DOCUMENTS

| | | |
|---|---|---|
| CH | 215110 | 9/1941 |
| CN | 102740730 | 10/2012 |

(Continued)

OTHER PUBLICATIONS

Corresponding Chinese Search Report dated Apr. 25, 2016.

(Continued)

*Primary Examiner* — Laura C Guidotti

(57) ABSTRACT

An oral care implement is provided. The implement comprises a head having a first surface and a group of non-parallel tooth cleaning elements extending from the first surface of the head. The tooth cleaning elements together define therebetween a conically-shaped cavity. Moreover, the tooth cleaning elements together define a wall around the cavity, the wall having a proximal end adjacent the first surface of the head and a distal end distal from the first surface of the head, the distal end of the wall being defined by distal ends of a plurality of the tooth cleaning elements.

23 Claims, 4 Drawing Sheets

(56) References Cited

U.S. PATENT DOCUMENTS

| | | | | |
|---|---|---|---|---|
| 4,268,933 | A | 5/1981 | Pappas | |
| 5,144,712 | A | 9/1992 | Hansel et al. | |
| 5,535,474 | A | 7/1996 | Salazar | |
| 5,590,438 | A * | 1/1997 | Chen | A46B 3/16 15/167.1 |
| 6,108,849 | A | 8/2000 | Weihrauch | |
| 6,311,360 | B1 * | 11/2001 | Lanvers | A46B 3/16 15/167.1 |
| 6,490,747 | B1 | 12/2002 | Metwally | |
| 7,143,462 | B2 | 12/2006 | Hohlbein | |
| 7,788,756 | B2 | 9/2010 | Kraemer | |
| 7,954,191 | B2 | 6/2011 | Hohlbein | |
| 8,042,217 | B2 * | 10/2011 | Sorrentino | A46B 9/026 15/167.1 |
| 8,398,326 | B2 | 3/2013 | Jimenez et al. | |
| 2010/0024142 | A1 | 2/2010 | Townley | |
| 2010/0088836 | A1 | 4/2010 | Kirchhofer et al. | |
| 2011/0030160 | A1 | 2/2011 | Knutzen et al. | |
| 2011/0047736 | A1 | 3/2011 | Jimenez et al. | |
| 2011/0072604 | A1 | 3/2011 | Alvarenga | |
| 2011/0109149 | A1 | 5/2011 | Loetscher et al. | |
| 2011/0203066 | A1 | 8/2011 | Hahn | |

FOREIGN PATENT DOCUMENTS

| | | | |
|---|---|---|---|
| DE | 102009009034 | | 8/2010 |
| GB | 430329 | A | 6/1935 |
| GB | 490892 | | 8/1938 |
| GB | 2085717 | B | 5/1982 |
| JP | 09-313255 | | 12/1997 |
| JP | 2002-345555 | | 12/2002 |
| JP | 2005-245719 | | 9/2005 |
| WO | WO2008098721 | | 8/2008 |
| WO | WO2009146909 | | 12/2009 |

OTHER PUBLICATIONS

Corresponding Chinese Office Action dated May 5, 2016.

International Search Report and the Written Opinion of the International Searching Authority issued in International Patent Application PCT/US2012/070760 dated Oct. 14, 2013.

Written Opinion of the International Preliminary Examining Authority issued in International Patent Application PCT/US2012/070760 dated Mar. 9, 2015.

* cited by examiner

ORAL CARE IMPLEMENT

CROSS-REFERENCE TO RELATED PATENT APPLICATIONS

This application is a U.S. national stage application under 35 U.S.C. § 371 of PCT Application No. PCT/US2012/070760, filed Dec. 20, 2012, the entirety of which is incorporated herein by reference.

BACKGROUND OF THE INVENTION

Oral care implements, especially toothbrushes, are used by many people on a daily basis. Typical oral care implements comprise an elongate handle and a head connected to one end of the handle. The handle provides a structure by which a user grips and manipulates the oral care implement during use. The head typically comprises one or more elements designed to perform their intended function, such as tooth cleaning elements, soft tissue cleaning elements, and/or oral care agents.

Toothbrushes are oral care implements having one or more tooth cleaning elements, which are used to clean teeth by removing plaque and debris from surfaces of the teeth. Conventional toothbrushes are limited in their ability to retain dentifrice for cleaning teeth. During an oral care session, the dentifrice typically slips through the tooth cleaning elements, such as tufts of bristles, and away from the contact zone of the cleaning elements with the teeth. As a result, the dentifrice often is spread around the mouth, rather than being concentrated on the contact zone. Therefore, the efficiency of the cleaning process is reduced.

Over the years, efforts have been made to improve the design of oral care implements, in order that they may deliver improved cleaning of users' oral cavities during oral care sessions. Such efforts have included the development of heads carrying structures intended to better retain dentifrice for use in cleaning and/or polishing teeth.

Despite these efforts, a need still exists for an oral care implement with a head having a structure for better retaining dentifrice, to enable improved cleaning and/or polishing of a user's teeth. A need also exists for an oral care implement that is easier to clean after an oral care session.

SUMMARY OF THE INVENTION

A first aspect of the present invention provides an oral care implement, comprising: a head having a first surface; and a group of non-parallel tooth cleaning elements extending from the first surface of the head; wherein the tooth cleaning elements together define therebetween a conically-shaped cavity; wherein the tooth cleaning elements together define a wall around the cavity, the wall having a proximal end adjacent the first surface of the head and a distal end distal from the first surface of the head, the distal end of the wall being defined by distal ends of a plurality of the tooth cleaning elements; and wherein a thickness of the wall measured from an interior side of the wall facing the cavity to an opposite exterior side of the wall is less at the distal end of the wall than at the proximal end of the wall.

Optionally, plural tooth cleaning elements of the group are in contact with one another thereby forming an apex of the cavity.

Optionally, the head has a hole therein, and the group of non-parallel tooth cleaning elements extends from within the hole. The cavity may have an apex within the hole. Plural tooth cleaning elements of the group may be in contact with one another thereby forming the apex of the cavity.

A second aspect of the present invention provides an oral care implement, comprising: a head having a hole therein, the hole having an axis and a cross-sectional area orthogonal to the axis, wherein the cross-sectional area of the hole varies along the axis; and a group of non-parallel tooth cleaning elements extending from within the hole; wherein the tooth cleaning elements together define therebetween a conically-shaped cavity.

Optionally, plural tooth cleaning elements of the group are in contact with one another thereby forming an apex of the cavity.

Optionally, the cavity has an apex within the hole. Optionally, plural tooth cleaning elements of the group are in contact with one another thereby forming the apex of the cavity.

A third aspect of the present invention provides an oral care implement, comprising: a head having a hole therein; and a group of non-parallel tooth cleaning elements extending from within the hole; wherein the tooth cleaning elements together define therebetween a conically-shaped cavity having an apex within the hole.

Optionally, plural tooth cleaning elements of the group are in contact with one another thereby forming the apex of the cavity.

Optionally, in the oral care implement of the second or third aspect, the tooth cleaning elements together define a wall around the cavity, the wall having a proximal end adjacent a first surface of the head from which the group of non-parallel tooth cleaning elements extends, and a distal end distal from the first surface of the head, the distal end defined by distal ends of a plurality of the tooth cleaning elements. Optionally, a thickness of the wall measured from an interior side of the wall facing the cavity to an opposite exterior side of the wall is less at the distal end of the wall than at the proximal end of the wall.

Optionally, in the oral care implement of any one of the first to third aspects, the wall tapers in thickness from the proximal end of the wall to the distal end of the wall.

Optionally, in the oral care implement of any one of the first to third aspects, the wall is a continuous wall. The wall may be free of gaps therein.

Optionally, in the oral care implement of any one of the first to third aspects, a thickness of the wall measured from an interior side of the wall facing the cavity to an opposite exterior side of the wall is substantially constant around a full perimeter of the cavity at any point between the distal end of the wall and the proximal end of the wall.

Optionally, in the oral care implement of any one of the first to third aspects, a cross sectional area of the wall at the distal end of the wall is substantially equal to a cross sectional area of the wall at the proximal end of the wall.

Optionally, in the oral care implement of any one of the first to third aspects, the distal end of the wall has a substantially linear side profile.

Optionally, in the oral care implement of the third aspect, the hole has an axis and a cross-sectional area orthogonal to the axis, and wherein the cross-sectional area of the hole varies along the axis.

Optionally, in the oral care implement of the first or second aspect, the head has a hole therein, the hole having an axis and a cross-sectional area orthogonal to the axis, wherein the cross-sectional area of the hole varies along the axis, and wherein the group of non-parallel tooth cleaning elements extends from within the hole.

Optionally, in the oral care implement of any one of the first to third aspects, the hole comprises a tapered hole.

Optionally, in the oral care implement of any one of the first to third aspects, the head comprises a member, the hole comprises a passage extending through the member, and the tooth cleaning elements extend through the passage so that respective first portions of the tooth cleaning elements are disposed on a first side of the member and respective second portions of the tooth cleaning elements are disposed on a second side of the member. The cavity may have an apex on the second side of the member. The cavity may have an apex in the passage. Optionally, the tooth cleaning elements of the group are fused together on the second side of the member. Optionally, the passage has a length between the first and second sides of the member of from 0.5 to 2.0 mm.

Optionally, in the oral care implement of any one of the first to third aspects, the head has a second surface comprising a soft tissue cleaner. Optionally, the soft tissue cleaner is in contact with tooth cleaning elements of the group. Optionally, the soft tissue cleaner is adhered to, and/or fills gaps between, the tooth cleaning elements.

Optionally, in the oral care implement of any one of the first to third aspects, each of the tooth cleaning elements of the group is substantially linear.

Optionally, in the oral care implement of any one of the first to third aspects, the group of tooth cleaning elements comprises a tuft of bristles.

Optionally, in the oral care implement of any one of the first to third aspects, some or all of the group of tooth cleaning elements are tapered bristles.

Optionally, in the oral care implement of any one of the first to third aspects, the cavity has the shape of a full cone.

Optionally, in the oral care implement of any one of the first to third aspects, the cavity has the shape of a truncated cone.

Optionally, in the oral care implement of any one of the first to third aspects, the cavity has the shape of a right cone.

Optionally, in the oral care implement of any one of the first to third aspects, the cavity has the shape of a circular cone or of an elliptical cone or of a pyramid.

Optionally, in the oral care implement of any one of the first to third aspects, the cavity has an opening defined by distal ends of a plurality of the tooth cleaning elements, and wherein the cavity reduces in cross-sectional area as distance into the cavity from the opening increases.

Optionally, the oral care implement of any one of the first to third aspects further comprises a pointed cleaning element having a pointed distal end and extending from the first surface of the head. Optionally, the pointed cleaning element comprises a group of bristles together defining a pointed bristle tuft, wherein each of the bristles has a distal end, and wherein the distal ends of the bristles together define a pointed distal end of the bristle tuft. Optionally, the head has a first end, a second end, and a longitudinal axis extending between the first and second ends; and a plurality of said pointed cleaning elements are disposed on the head spaced along the longitudinal axis. Optionally, the oral care implement comprises a plurality of said pointed cleaning elements and a plurality of said groups of non-parallel tooth cleaning elements. The head may have a first end and a second end; and the pointed cleaning elements may alternate with the groups of non-parallel tooth cleaning elements between the first end and the second end of the head. Optionally, some or all of the bristles of the group of bristles together defining the pointed bristle tuft are tapered bristles.

BRIEF DESCRIPTION OF THE DRAWINGS

A more complete understanding of the present invention, and the advantages thereof, may be acquired by referring to the following description in consideration of the accompanying drawings, in which like reference numbers indicate like features, and wherein.

DETAILED DESCRIPTION OF THE PREFERRED EMBODIMENTS

Figure 1:
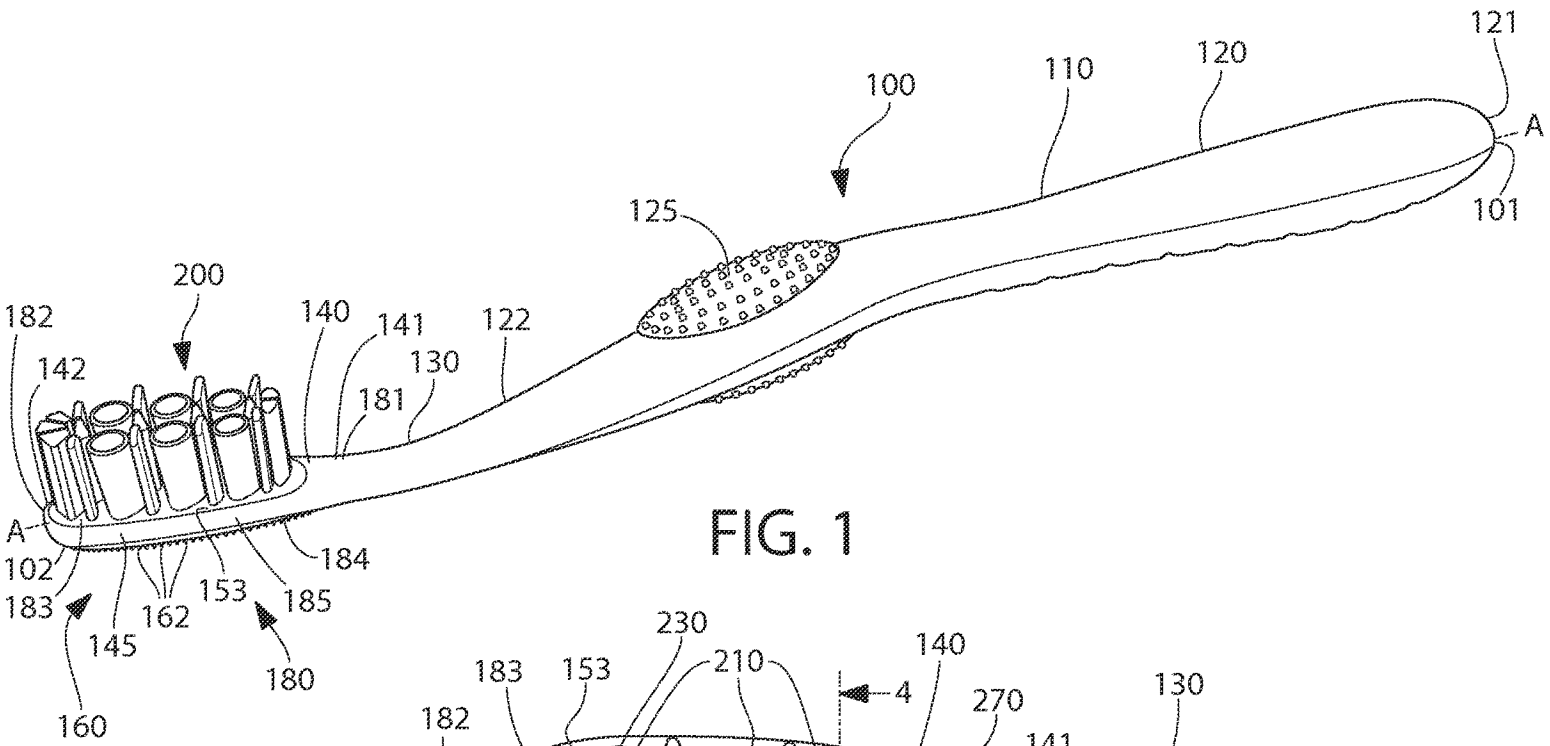
FIG. 1 is a perspective view of an oral care implement according to a first embodiment of the present invention.

The following description of the preferred embodiments is merely exemplary in nature and is in no way intended to limit the invention, its application, or uses. The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features.

In the following description, the invention is embodied in a manually-operated oral care implement, more specifically a manually-operated toothbrush. However, in other embodiments, the invention is embodied in a powered toothbrush wherein one or more cleaning elements provided to the head of the implement are drivable so as to be moved relative to the handle of the implement. In still further embodiments, the invention may be embodied in other forms of oral care implements, such as a soft-tissue cleansing implement, or another implement designed for oral care. It is to be understood that other embodiments may be utilised, and that structural and functional modifications may be made without departing from the scope of the present invention.

As used herein, the term "cone", and derivatives thereof such as "conical" and "conically", covers full cones and truncated cones, such as frusto-cones. As used herein, the term "apex" of a cavity means a, or the, deepest portion or point of the cavity from an open end of the cavity.

FIGS. 1 to 4 illustrate an oral care implement, in this case a toothbrush, according to a first embodiment of the present invention, generally designated with the reference numeral 100. The toothbrush 100 has a body 110 comprising a handle portion 120, a head portion 140, and a neck portion 130 that connects the handle portion 120 to the head portion 140. The head portion 140 is an end portion of the body 110 and is provided with a set 200 of cleaning elements for cleaning surfaces in a user's mouth, such as surfaces of their teeth.

The implement 100 has a head 180, comprising the head portion 140 of the body 110, the set 200 of cleaning elements, and a soft tissue cleaner 160, each of which is described in more detail below. In a variation to this embodiment, the soft tissue cleaner 160 is omitted.

The head portion 140 has a first, proximal end 141 and a second, distal end 142. The handle portion 120 has a first, proximal end 121 and a second, distal end 122. The neck portion 130 connects the distal end 122 of the handle portion 120 to the proximal end 141 of the head portion 140. The neck portion 130 is generally of a narrower cross sectional area than at least the distal end 122 of the handle portion 120 and, in some embodiments, the neck portion 130 is generally of a narrower cross sectional area than all portions of the handle portion 120.

The handle portion 120 of the body 110 provides the user with a mechanism by which he/she can readily grip and manipulate the toothbrush 100, includes ergonomic features which provide a high degree of control for the user while maintaining comfort, and may be formed of many different shapes and with a variety of constructions.

Generally, the toothbrush 100 extends from a proximal end 101 (which is also the proximal end 121 of the handle portion 120) to a distal end 102 (which is also the distal end 142 of the head portion 140) along a longitudinal axis A-A. Although the handle portion 120 is a non-linear structure in the illustrated embodiment, the longitudinal axis A-A of the implement 100 is linear in the illustrated embodiment. However, the invention is not so limited, and in certain embodiments, the implement 100 may have a simple linear handle portion 120 that is longitudinally aligned along the linear longitudinal axis A-A of the implement 100.

The head portion 140 is connected to the handle portion 120 via the neck portion 130. In this embodiment, the head portion 140, neck portion 130 and handle portion 120 are formed as an integral structure using an injection molding process. The head portion 140 is substantially immovable relative to the neck portion 130 and handle portion 120. The head portion 140, handle portion 120 and neck portion 130 are together a single, unitary structure. That is, the body 110 is a unitary body. However, in other embodiments, the head portion 140 and the neck portion 130 together may be formed as a separate component from the handle portion 120, which separate components are operably connected at a later stage of the manufacturing process by any suitable technique known in the art, including without limitation thermal welding, sonic welding, a tight-fit assembly, a coupling sleeve, adhesion, fasteners, and a snap-fit connection. Whether the head and neck portions 140, 130 and the handle portion 120 are constructed as a single piece or a multi-piece assembly (including connection techniques) is not limiting of the present invention in all embodiments. Furthermore, other manufacturing techniques may be used in place of and/or in addition to injection molding to create the handle portion 120 and/or the head portion 140 (or components thereof) and/or the neck portion 130, such as milling and/or machining.

In this embodiment, the body 110 comprising each of the head portion 140, neck portion 130 and handle portion 120 is constructed of a hard, substantially rigid material, specifically the hard plastic polypropylene (PP). However, in variations to this embodiment, the head portion 140 may instead or additionally be constructed of one or more of the following hard materials: polyethylene, polypropylene, polyamide, polyester, cellulosics, styrene-acrylonitrile (SAN), acrylic, acrylonitrile butadiene styrene (ABS) and a thermoplastic. Also, in variations to this embodiment, the handle portion 120 and/or the neck portion 130 may instead or additionally be constructed of one or more of those materials. An optional thumb grip 125 is provided on a front side of the handle portion 120, and an optional rear grip 127 is provided on a rear side of the handle portion 120 opposite to the front side of the handle portion 120. The thumb and rear grips 125, 127 are non-unitary with the body 110, and may be formed of any of the materials discussed below for the soft tissue cleaner 160.

The head 180 generally comprises a first surface 183, on a front side of the head 180, and a second surface 184, on a rear side of the head 180 opposite to the first side and thus opposite to the first surface 183. The first surface 183 and the second surface 184 of the head 180 can take on a wide variety of shapes and contours, none of which are limiting of the present invention. For example, the first and second surfaces 183, 184 can be planar, contoured or combinations thereof. The first surface 183 and second surface 184 are joined by a peripheral or lateral surface 145 of the head portion 140, which is a peripheral or lateral surface 185 of the head 180. The cleaning elements of the set 200 are provided at, and extend outward from, the first surface 183 of the head 180 for cleaning contact with an oral surface, preferably teeth.

While the set 200 of cleaning elements is particularly suited for cleaning teeth, the set 200 of cleaning elements can also be used to clean oral soft tissue, such as a tongue, gums, or cheeks instead of or in addition to teeth. As used herein, the term "cleaning element" is used in a generic sense to refer to any structure that can be used to clean, massage or polish an oral surface, such as teeth or soft tissue, through relative surface contact.

In this embodiment, the set 200 of cleaning elements comprises the following different types of cleaning elements, each of which extends from the first surface 183 of the head 180 and is discussed in more detail below: groups 210 of non-parallel tooth cleaning elements 220, pointed cleaning elements 250, raised cleaning elements 260, and distal and proximal cleaning elements 270.

Figure 4:
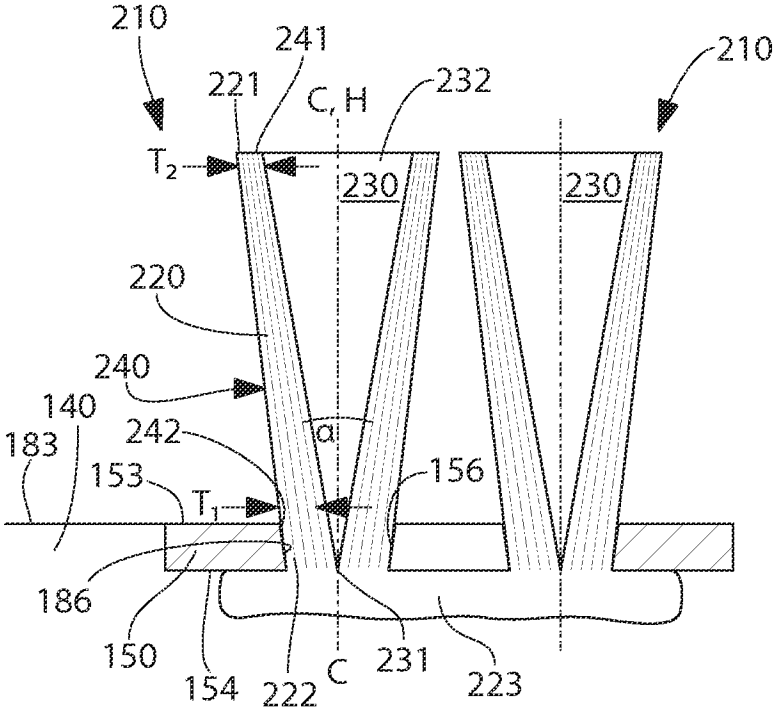
FIG. 4 is a partial cross-sectional view of the head taken along line 4-4 in FIG. 2.
Figure 3:
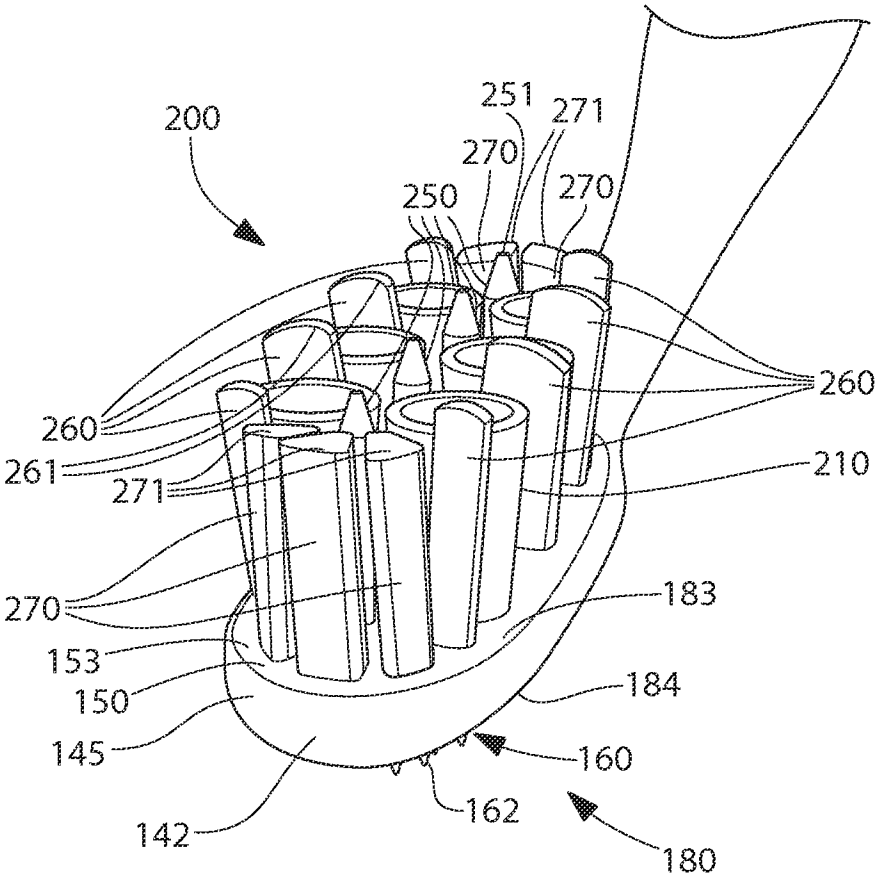
FIG. 3 is an enlarged perspective view of the head of the implement of FIG. 1.

With reference specifically to FIG. 4, the groups 210 of tooth cleaning elements 220 will be described. In this embodiment, the implement 100 has a plurality of groups 210 of tooth cleaning elements 220. However, in variations to this embodiment, such as the third embodiment shown in FIGS. 7 and 8 and discussed below, only one group 210 of non-parallel tooth cleaning elements 220 is provided. For simplicity, only one of the groups 210 of the first embodiment will be described in detail, but it will be understood that each of the groups 210 of the first embodiment is of substantially the same construction.

Each of the non-parallel tooth cleaning elements 220 of the group 210 is a flexible, nylon bristle that extends from the first surface 183 of the head 180. Accordingly, the group 210 of non-parallel tooth cleaning elements 220 comprises a tuft of bristles. The non-parallel nature of the tooth cleaning elements 220 of the group 210 results from some, or all, of the tooth cleaning elements 220 of the group 210 not being parallel to others of the tooth cleaning elements 220 of the group 210. Each of the tooth cleaning elements 220 has a (optionally tapered) distal end 221 furthest from the first surface 183 of the head 180, an opposite proximal end 222, and is linear, or substantially linear, between its distal end 221 and the first surface 183 of the head 180.

The tooth cleaning elements 220 define therebetween a cavity 230. That is, the cavity 230 is located between the tooth cleaning elements 220 and is bound by the tooth cleaning elements 220. More specifically, the tooth cleaning elements 220 together define a wall 240 around the cavity 230, the wall 240 having a proximal end 242 adjacent the first surface 183 of the head 180 and a distal end 241 distal from the first surface 183 of the head 180, the distal end 241 being defined by distal ends 221 of a plurality (optionally all) of the tooth cleaning elements 220. The wall 240 surrounds the cavity 230. In the present embodiment, in which the tooth cleaning elements 220 of the group 210 are packed closely together so that each of the tooth cleaning elements 220 of the group 210 contacts at least one other of the tooth cleaning elements 220 of the group 210, the wall 240 is a continuous wall 240 around the cavity 230. Preferably the wall 240 extends for 360 degrees around the cavity 230. Preferably the wall 240 is free of gaps therein.

In this embodiment, the distal end 241 of the wall 240 has a substantially linear side profile. In this embodiment, the distal end 241 of the wall 240 is substantially planar. Moreover, the distal end 241 of the wall 240 is substantially parallel to the first surface 183 of the head 180. In other embodiments, the distal end 241 of the wall 240 could be non-planar and/or non-parallel to the first surface 183 of the head 180. In still further variations to this embodiment, the distal end 241 of the wall 240 may have an alternative side profile, such as a non-linear profile, an S-shaped profile, a wavy profile, a serrated profile, a U-shaped profile, a V-shaped profile, or a pointed profile.

A thickness T of the wall 240 measured from an interior side 243 of the wall 240 facing the cavity 230 to an opposite, exterior side 244 of the wall 240 is less at the distal end 241 of the wall 240 than at the proximal end 242 of the wall 240. That is, the thickness T2 of the wall 240 at the distal end 241 of the wall 240 is less than the thickness T1 of the wall 240 at the proximal end 242 of the wall 240. The maximum thickness T1 of the wall 240 is at the proximal end 242 of the wall 240, while the minimum thickness T2 of the wall 240 is at the distal end 241 of the wall 240. The thickness of the wall 240 decreases linearly (i.e. at a regular rate) between the proximal end 242 of the wall 240 and the distal end 241 of the wall 240. That is, the wall 240 tapers in thickness from the proximal end 242 of the wall 240 to the distal end 241 of the wall 240. Moreover, a cross sectional area of the wall 240 at the distal end 241 of the wall 240 is substantially equal to a cross sectional area of the wall 240 at the proximal end 242 of the wall 240. Furthermore, at any point between the distal end 241 and the proximal end 242 of the wall 240, the thickness of the wall 240 is substantially constant around a full perimeter of the cavity 230. The wall 240 is preferably rotationally symmetrical.

The cavity 230 has an opening 232 at the distal end 241 of the wall 240 and an apex 231 at a position in the cavity 230 furthest from the distal ends 221 of the tooth cleaning elements 220 of the group 210, i.e. furthest from the opening 232 of the cavity 230. In this embodiment, the apex 231 is formed at the point (see FIG. 4) where plural of the tooth cleaning elements 220 of the group 210 are in contact with one another. The significance of the cavity 230 having an apex 231, and more specifically an apex 231 formed by the tooth cleaning elements 220 rather than by some other element, such as part of the first surface 183 of the head 180, will be explained below.

In this embodiment, the apex 231 is within a hole 186 in the head 180, and the group 210 of non-parallel tooth cleaning elements 220 extends from within the hole 186. The hole 186 has an axis H-H and a cross-sectional area orthogonal to the axis H-H. The cross-sectional area of the hole 186 varies along the axis H-H. In particular, the hole 186 is a tapered hole 186, whereby the cross-sectional area reduces as distance into the hole 186 from the first surface 183 increases. In other embodiments, the hole 186 is not tapered.

In this embodiment, the cavity 230 is conically-shaped, with an axis C of the cone being the imaginary straight line that passes through the apex 231 and about which the opening 232 has rotational symmetry. More specifically, in this embodiment the cavity 230 has the shape of a right circular full cone, whereby the opening 232 is circular and substantially planar, and the axis C of the cone passes through the opening 232 at right angles to the plane of the opening 232. In a variation, the opening 232 may instead by elliptical (and optionally substantially planar), so that the cavity has the shape of an elliptical cone, optionally a right elliptical cone. In further variations to this embodiment, the cavity 230 may instead take the shape of an oblique circular or elliptical cone, in which the axis C is not at right angles to the plane of the opening 232. In other embodiments, the opening 232 could take a still different shape, such as a square or rectangle, in which case the cavity 230 would have the shape of a pyramid (note that a pyramid is a cone with a polygonal base). In still other embodiments, instead of having the shape of a full cone, the cavity 230 could instead have the shape of a truncated cone, such as a frusto-cone, n which case the apex 231 would not be a point as such, but instead would be an area preferably formed by material of plural of the tooth cleaning elements 220 of the group 210.

Preferably, a distance between two diametrically-opposed cavity-facing points on the wall 240 (which points would be located at or adjacent the opening 232) is at least 10 times the width of any one of the tooth cleaning elements 220. In other words, preferably a width of the opening 232 is at least 10 times the width of any one of the tooth cleaning elements 220. More preferably, this multiple is at least 20 times, and most preferably, this multiple is at least 30 times or at least 40 times. Preferably, the distance is at least 5 times the thickness T2 of the wall 240 at the distal end 241 of the wall 240, and most preferably the distance is at least 10 times the thickness T2 of the wall 240 at the distal end 241 of the wall 240.

Preferably, the internal angle $\alpha$ of the conical cavity, i.e. the angle at the apex 231 of the cavity 230, is at least 20 degrees. More preferably, the angle $\alpha$ is at least 25 degrees, or at least 30 degrees. Preferably, the angle $\alpha$ is less than 45 degrees, and more preferably the angle $\alpha$ is less than 40 degrees, or less than 35 degrees. In some embodiments, this angle $\alpha$ is the angle between two diametrically-opposed cavity-facing tooth cleaning elements 220 of the group 210.

In this embodiment, each of the groups 210 of tooth cleaning elements 220 comprises a plurality of flexible, nylon bristles 220. However, in variations to this embodiment, the tooth cleaning elements 220 of the group(s) 210 may additionally or alternatively comprise any one or more of the following, without limitation: rigid bristles, filament bristles, fibre bristles, nylon bristles, spiral bristles, tapered bristles, rubber bristles, elastomeric protrusions, flexible polymer protrusions, co-extruded filaments, flag bristles, crimped bristles, anti-bacterial bristles and combinations thereof and/or structures containing such materials or combinations.

The tooth cleaning elements 220 of the group(s) 210 can be connected to the head 140 using anchor free tufting (AFT). Alternatively, the cleaning elements 220 could be mounted to tuft blocks or sections by extending through suitable openings in the tuft blocks so that the base of the cleaning elements 220 is mounted within or below the tuft block. Staple technology may instead be used.

In AFT, the tooth cleaning elements 220 (bristles or other elements, such as elastomeric elements) are arranged to extend through a passage 156 in a member 150, which in this embodiment is a plate but in a variation to this embodiment is a membrane. Respective first portions, i.e. free distal ends, 221 of the tooth cleaning elements 220 on a first side 153 of the plate 150 perform the cleaning function. Respective second portions, e.g. proximal ends, 222 of the tooth cleaning elements 220 on a second side 154 of the plate 150 are fused, or melted together, by heat to form a melt matte 223 and to be anchored in place relative to the plate 150. The plate 150 is secured to the pre-made head portion 140, such as by ultrasonic welding. Alternatively, the material of the head portion 140 is subsequently moulded over the member 150 to envelop, or substantially envelop, the member 150.

Although, as shown in FIG. 4, the member 150 is a plate or membrane that is a separate entity to the head portion 140, in a variation to this embodiment the member 150 is part of the head portion 140 itself, which head portion 140 may be unitary with, or otherwise connected to, the handle portion 120 and/or the neck portion 130 of the implement 100, and thus is part of the head 180. In either arrangement, the hole 186 comprises the passage 156 through the member 150. Preferably, the passage 156 has a length between the first and second sides 153, 154 of the member 150 of from 0.5 mm to 2.0 mm, more preferably from 0.75 mm to 1.5 mm.

From FIG. 4, it can be seen that the apex 231 of the cavity 230 is disposed in the hole 186 on the second side 154 of the member 150. However, in a variation to this embodiment, the apex 231 is disposed in the passage 156, which is comprised in the hole 186. In this embodiment, the passage 156 in the member 150 is a tapered passage. However, in other embodiments, this need not be the case.

At the rear side of the head 180 is disposed the soft tissue cleaner 160, preferably formed from resilient material. The soft tissue cleaner 160 is comprised in the second surface 184 of the head 180. The soft tissue cleaner 160 comprises a pad and a plurality of flexible protrusions 162 protruding from the pad. Preferably, the pad also is of a flexible material and the pad and protrusions 162 are a unitary component. Preferably the pad and the protrusions 162 are made of an elastomer, such as a thermoplastic elastomer (TPE), or styrene-ethylene/butylene-styrene (SEBS).

Some methods of manufacturing an oral care implement 100 according to the present invention will now be described. Broadly speaking, each of the methods comprises: providing a member 150 and providing a group 210 of non-parallel tooth cleaning elements 220 that together define therebetween a conically-shaped cavity 230, wherein the tooth cleaning elements 220 extend through a passage 156 formed in the member 150 so that respective first portions 221 of the tooth cleaning elements 220 are disposed on a first side 153 of the member 150 and respective second portions 222 of the tooth cleaning elements 220 are disposed on a second side 154 of the member 150, and then fixing together the second portions 222 of the tooth cleaning elements 220 at the second side 154 of the member 150.

As shown in FIG. 4, the member 150 may be a plate or membrane that is a separate entity to a head portion 140 of the implement 100. Alternatively, the member is part of the head portion 140. The head portion 140 may be unitary with, or otherwise connected to, the handle portion 120 and/or the neck portion 130 of the implement 100.

The method of manufacture of the implement 100 shown in FIG. 1 comprises inserting the tooth cleaning elements 220 (each of which is a bristle, optionally a tapered bristle) into the tapered passage 156, so that each of the tooth cleaning elements 220 has a first portion 221 on the first side 153 of the member 150 and has a second portion 222 (in this embodiment, a proximal end) on the second side 154 of the member 150, and then arranging the tooth cleaning elements 220 so that together the tooth cleaning elements 220 define therebetween the conically-shaped cavity 230.

More specifically, in one embodiment, the inserting comprises disposing a plurality of (preferably between two and four) picks (i.e. individual clusters) of mutually-aligned tooth cleaning elements 220 into the passage 156 with the picks at respective different orientations relative to one another. Each of the picks may be inserted into the passage 156 from a different direction to each of the other picks with the picks at respective different orientations relative to one another during the inserting, or all of the picks may be inserted into the passage 156 from the same direction, for example in a direction parallel to the shortest distance between the first and second sides 153, 154 of the member 150, with the picks at respective different orientations relative to one another during the inserting. Either way, the inserting comprises disposing at least some of the tooth cleaning elements 220 in the passage 156 at a different orientation to others of the tooth cleaning elements 220. The picks may be inserted into the passage 156 at the same time or successively.

In a variation to this process, the tooth cleaning elements 220 (whether in individual picks or as one set) are all inserted into the passage 156 with all the tooth cleaning elements 220 being substantially parallel to one another.

The arranging may comprise moving at least some of the tooth cleaning elements 220 relative to others of the tooth cleaning elements 220 and relative to the member 150 to cause the tooth cleaning elements 220 to define therebetween the conically-shaped cavity 230, such as by introducing the first portions 221 of the tooth cleaning elements 220 into a mold (not shown) and using the mold to move the tooth cleaning elements 220. Alternatively, the arranging may comprise allowing at least some of the tooth cleaning elements 220 to move relative to others of the tooth cleaning elements 220 and relative to the member 150 to cause the tooth cleaning elements 220 to define therebetween the conically-shaped cavity 230, such as by introducing the first portions 221 of the tooth cleaning elements 220 into a mold and allowing the tooth cleaning elements 220 to conform to a shape of the mold, e.g. under the influence of gravity.

In any event, ultimately the tooth cleaning elements 220 extending through the passage 156 have respective different orientations relative to one another. Each of the tooth cleaning elements 220 of the group 210 extends through the passage 156 with a distal end 221 thereof on the first side 153 of the member 150 and the proximal end 222 thereof on the second side 154 of the member 150. The tooth cleaning elements 220 of the group 210 are positioned so that they contact one another on the second side 154 of the member 150, and are splayed apart from one another on the first side 153 of the member 150. Over all, the tooth cleaning elements 220 define the conically-shaped cavity 230 therebetween. The tooth cleaning elements 220 may contact one another at their proximal ends 222, or at respective points a short distance from their respective proximal ends 222, to define the apex 231 of the cavity 230. As discussed above, the cavity 230 of the implement 100 has the shape of a right circular full cone. In other embodiments, depending on the relative orientations of the tooth cleaning elements 220, the cavity 230 may instead have any of the other shapes discussed above.

Next, the tooth cleaning elements 220 are fixed at respective different orientations relative to one another by holding the tooth cleaning elements 220 and heating up the second portions 222 (i.e. the proximal ends, in this embodiment) of the tooth cleaning elements 220 to cause the second portions 222 to melt and run into one another. The heat is then removed and the second portions 222 of the tooth cleaning elements 220 are allowed to cool and harden into one monolithic mass or melt matte 223, so that the picks of tooth cleaning elements 220 become fused together at the second side 154 of the member 150. In some embodiments, the second portions 222 of the tooth cleaning elements 220 become fixed to the member 150 during this process.

Preferably, this process results in the apex 231 of the cavity 230 becoming formed on the second side 154 of the member 150. However, in other cases, the apex 231 may become formed within the passage 156. The position of the apex 231 may change during the fixing process as material of the tooth cleaning elements 220 flows. Where the apex 231 is formed relative to the passage 156 and relative to the member 150 as a whole depends upon how close to one another tooth cleaning elements 220 are held, the length of time for which the heating is carried out, and the material of the tooth cleaning elements 220. In any case, the fixed group 210 of non-parallel tooth cleaning elements 220 together define the wall 240, discussed above. As also discussed above, preferably the wall 240 is a continuous wall, and more preferably the wall 240 is free of gaps therein. Moreover, while in this embodiment the passage 156 is tapered and has a length of between 0.5 and 2.0 mm, in variations to this embodiment the passage 156 is not tapered and/or has a different length.

Next, in embodiments where the member comprises a plate or membrane 150 separate from the head portion 140, such as the embodiment shown in FIGS. 1 to 4, the member 150 including the group(s) 210 of tooth cleaning elements 220 is attached to the head portion 140 so that the member 150 becomes provided in the head 180 of the implement 100. This attaching may be by one of the methods discussed above. The first side 153 of the member 150 effectively forms part or all of the first surface 183 of the head 180, so that the group 210 of non-parallel tooth cleaning elements 220 extends from the first surface 183 of the head 180. In variations to this embodiment, the member 150 may end up embedded within the head 180. In alternative embodiments where the member 150 comprises part of the head portion 140, then this attachment process can be omitted.

The method of manufacturing the implement 100 shown in FIGS. 1 to 4 also includes providing the soft tissue cleaner 160 to form at least part of the second surface 184 of the head 180, which second surface 184 of the head 180 is opposite to the first surface 183 of the head 180. In some embodiments, the soft tissue cleaner 160 is in contact with the tooth cleaning elements 220 of the group 210, more specifically with the proximal ends 222 thereof. The soft tissue cleaner 160 may be a pre-made entity, for example made of TPE, which is adhered to the head portion 140 and to the tooth cleaning elements 220 of the group 210. Alternatively, the method may involve flowing a material, such as a TPE, onto the melt matte 223, and into any gaps left between the tooth cleaning elements 220 at or around their proximal ends 222, and then allowing the material to harden to form the soft tissue cleaner 160. The soft tissue cleaner 160 thus can be bound to the tooth cleaning elements 220 of the group 210.

The oral care implement 100 may be manufactured by a different method. For example, the hole(s) 186, the passage 156 and the member 150 may be omitted altogether. The tooth cleaning elements 220 may be individually provided to the first side 183 of the head 180, or a unitary structure including the individual tooth cleaning elements 220 may be provided to the first side 183 of the head 180 or to the hole 186. Such a unitary structure may be made of TPE.

A first benefit of the provision of the conically-shaped cavity 230 is that it provides the head 180 with a large volume for retaining toothpaste.

A second benefit of this structure is that the cavity 230 is easy to clean of toothpaste following a teeth cleaning session, since toothpaste captured in the cavity 230 is entirely or substantially unable to work its way down to the first surface 183 of the head 180 where it may become trapped. It is preferable that the cavity 230 has an apex 231 in the form of a point. In such cases, the toothpaste still less able to work its way down to the first surface 183 of the head 180.

A third benefit of the conically-shaped cavity 230 is that it holds the majority of the toothpaste at a position where it will be effective at cleaning the teeth. This is particularly the case in embodiments in which the wall 240 is a continuous wall 240 around the cavity 230, and more particularly the case when the cavity 230 has an apex 231 in the form of a point.

A fourth benefit of the structure is that, in embodiments where the tooth cleaning elements 220 are flexible, during a teeth cleaning session the tooth cleaning elements 220 are able to bend, flex or rotate (about the point apex 231, when provided) to come into contact with each other at, or close to, their distal ends 221. Thus, the cavity 230 is able to be significantly reduced in volume to cause toothpaste held in the cavity 230 to be completely, or substantially completely, expelled from the cavity 230 onto the teeth during a teeth cleaning session. As a result, the toothpaste becomes positioned at a contact zone of the tooth cleaning elements 220 with the teeth, thus enabling improved cleaning and/or polishing of a user's teeth using the toothpaste.

As discussed above, the set 200 of cleaning elements comprises pointed cleaning elements 250 that extend from the first surface 183 of the head 180 and have respective pointed distal ends 251. In each pointed cleaning element 250, the pointed distal end 251 is that part of the pointed cleaning element 250 furthest from the first surface 183 of the head 180. In some embodiments each pointed cleaning element 250 is an elastomeric component. However, in the present embodiment, each pointed cleaning element 250 comprises a group of bristles, wherein each of the bristles has a distal end furthest from the first surface 183 of the head 180, and wherein the distal ends of the bristles together define a pointed distal end 251 of the pointed cleaning element 250. The distal ends of some or all of the bristles themselves may be any shape, including flat, rounded or tapered. The distal ends 251 of the pointed cleaning elements 250 are further from the first surface 183 of the head 180 than the distal ends 221 of the non-parallel tooth cleaning elements 220 making up the groups 210. Due to their shape and height relative to the groups 210 of non-parallel tooth cleaning elements 220, the pointed cleaning elements 250 are particularly effective at cleaning between a user's teeth.

Figure 2:
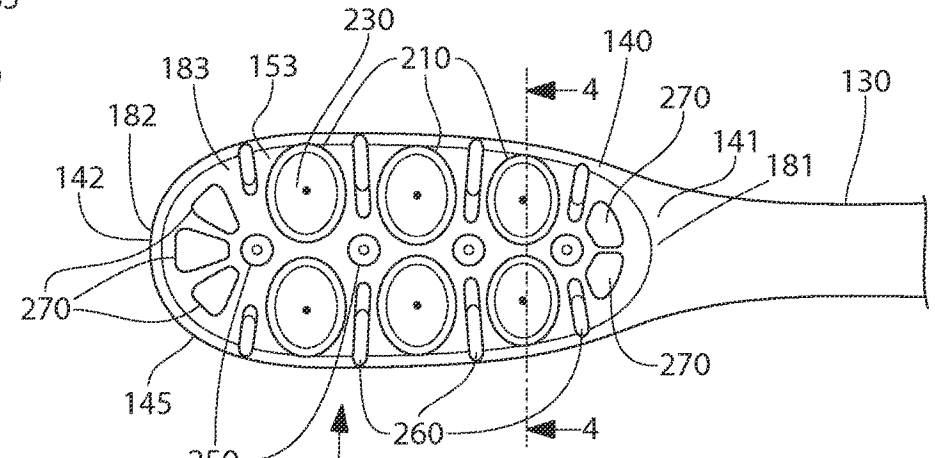
FIG. 2 is an enlarged plan view of a head of the implement of FIG. 1.

As is best shown in FIG. 2, the head 180 has a first end 181 and a second end 182. An axis extends between the first and second ends 181, 182, which axis is parallel to the longitudinal axis A-A of the implement 100 and extends along the longitudinal middle of the head 180. Plural ones of said pointed cleaning elements 250 are disposed on the head 180 spaced along this axis. More particularly, the implement 100 comprises a plurality of said pointed cleaning elements 250, and a plurality of said groups 210 of non-parallel tooth cleaning elements 220. The pointed cleaning elements 250 alternate with the groups 210 of non-parallel tooth cleaning elements 220 between the first end 181 and the second end 182 of the head 180. That is, between any two of the pointed cleaning elements 250, there is provided a pair of laterally-spaced groups 210 of the non-parallel tooth cleaning elements 220.

As discussed above, the set 200 of cleaning elements comprises raised cleaning elements 260 that extend from the first surface 183 of the head 180. Each of these cleaning elements 260 has a convex distal end 261 which is that part of the raised cleaning element 260 furthest from the first surface 183 of the head 180. In some embodiments each raised cleaning element 260 is an elastomeric component. However, in the present embodiment, each raised cleaning element 260 comprises a group of bristles, wherein each of the bristles has a distal end furthest from the first surface 183 of the head 180, and wherein the distal ends of the bristles together define a convex distal end 261 of the raised cleaning element 260. The distal ends of the bristles themselves may be any shape, including flat, rounded or tapered. The distal ends 261 of the raised cleaning elements 260 are further from the first surface 183 of the head 180 than the distal ends 221 of the non-parallel tooth cleaning elements 220 making up the groups 210, and approximately the same distance from the first surface 183 of the head 180 as the distal ends 251 of the pointed cleaning elements 250. Due to their shape and height relative to the groups 210 of non-parallel tooth cleaning elements 220, the raised cleaning elements 260 are particularly effective at sweeping away plaque and debris from surfaces in a user's mouth.

As is best shown in FIG. 2, plural ones of said raised cleaning elements 260 are disposed longitudinally spaced along the lateral edges of the first surface 183 of the head 180. The raised cleaning elements 260 alternate with the groups 210 of non-parallel tooth cleaning elements 220 between the first end 181 and the second end 182 of the head 180, so that pairs of the raised cleaning elements 260 are longitudinally positioned on the head 180 in alignment with ones of the pointed cleaning elements 250, so that the raised cleaning elements 260 flank the pointed cleaning element 250 on their lateral sides.

As discussed above, the set 200 of cleaning elements comprises distal and proximal cleaning elements 270 that extend from the first surface 183 of the head 180. The distal and proximal cleaning elements 270 are disposed at the first and second ends 181, 182 of the head 180. In some embodiments each of the distal and proximal cleaning elements 270 is an elastomeric component. However, in the present embodiment, each distal and proximal cleaning element 270 comprises a group of bristles, wherein each of the bristles has a distal end furthest from the first surface 183 of the head 180, and wherein the distal ends of the bristles together define a sloped distal end 271 of the distal and proximal cleaning element 270 that has a peak furthest from the centre of the first surface 183 of the head 180. The distal ends of the bristles themselves may be any shape, including flat, rounded or tapered. The peaks of the sloped distal ends 271 are approximately the same distance from the first surface 183 of the head 180 as the distal ends 251 of the pointed cleaning elements 250. Due to their shape, peak height and positioning on the head 180, the distal and proximal cleaning elements 270 are also effective at cleaning between a user's teeth. The distal cleaning elements 270 also are useable to reach far into the user's mouth, to clean effectively their rearmost molars.

Figure 5:
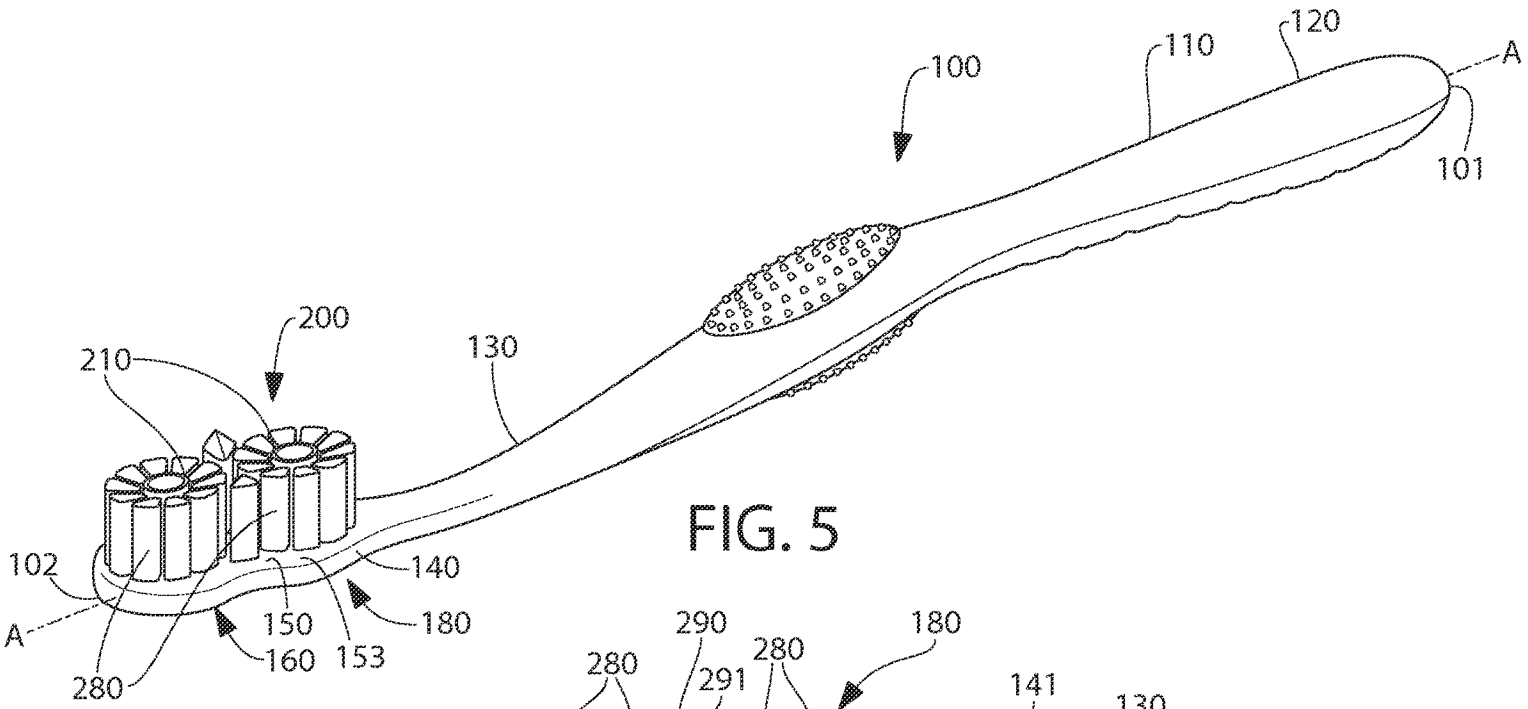
FIG. 5 is a perspective view of an oral care implement according to a second embodiment of the present invention.
Figure 6:
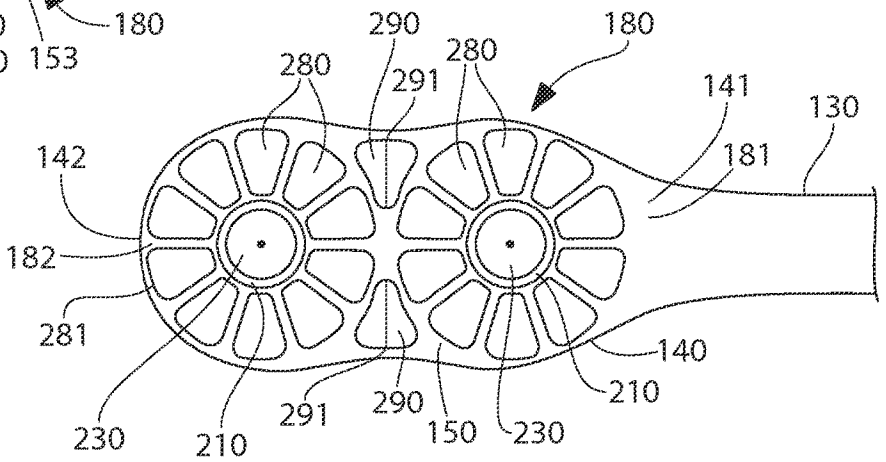
FIG. 6 is an enlarged plan view of a head of the implement of FIG. 5.

A second embodiment of the implement 100 of the present invention is shown in FIGS. 5 and 6. Like elements shown in FIGS. 1 to 4 are indicated in FIGS. 5 and 6 with the same reference numerals. In the interests of conciseness, the elements common to the two embodiments will not be described in detail again with reference to FIGS. 5 and 6. All of the above-described possible variations to the first embodiment are equally applicable to the second embodiment.

Whereas in the first embodiment the head 180 had a substantially elliptical or lozenge-shape, the head 180 of the implement 100 of the second embodiment has an outer shape in plan view similar to the outer edge of a number 8. The head 180 has a first end 181 and a second end 182. An axis extends between the first and second ends 181, 182, which axis is parallel to the longitudinal axis A-A of the implement 100 and extends along the longitudinal middle of the head 180. The head 180 includes only two groups 210 of non-parallel tooth cleaning elements 220 disposed on the head 180 spaced along this axis.

Surrounding each of the two groups 210 is a plurality of wedge-shaped cleaning elements 280, each of which has a wedge shape in plan view. In some embodiments each of the wedge-shaped cleaning elements 280 is an elastomeric component. However, in the present embodiment, each wedge-shaped cleaning element 280 comprises a group of bristles, wherein each of the bristles has a distal end furthest from the first surface 183 of the head 180, and wherein the distal ends of the bristles together define a sloped distal end 281 of the wedge-shaped cleaning element 280 that has a peak furthest from the centre of the cavity 230. The distal ends of the bristles themselves may be any shape, including flat, rounded or tapered.

At the longitudinal middle of the head 180, and disposed on the lateral edges of the first surface 183 of the head 180, is a pair of triangular-shaped cleaning elements 290, each of which has a substantially triangular shape in plan view. An inward-facing vertex of each of the triangular-shaped cleaning elements 290 faces an inward-facing vertex of the other of the triangular-shaped cleaning elements 290. In some embodiments each of the triangular-shaped cleaning elements 290 is an elastomeric component. However, in the present embodiment, each triangular-shaped cleaning element 290 comprises a group of bristles, wherein each of the bristles has a distal end furthest from the first surface 183 of the head 180, and wherein the distal ends of the bristles together define a pointed distal end 291 of the triangular-shaped cleaning element 290 that has a peak at the midpoint of the side of the triangle opposite from the inward-facing vertex. The distal ends of the bristles themselves may be any shape, including flat, rounded or tapered. The distal ends 291 of the triangular-shaped cleaning elements 290 are further from the first surface 183 of the head 180 than the distal ends 221 of the non-parallel tooth cleaning elements 220 making up the groups 210. Due to their shape and height relative to the groups 210 of non-parallel tooth cleaning elements 220, the triangular-shaped cleaning elements 290 are particularly effective at cleaning between a user's teeth.

Figure 7:
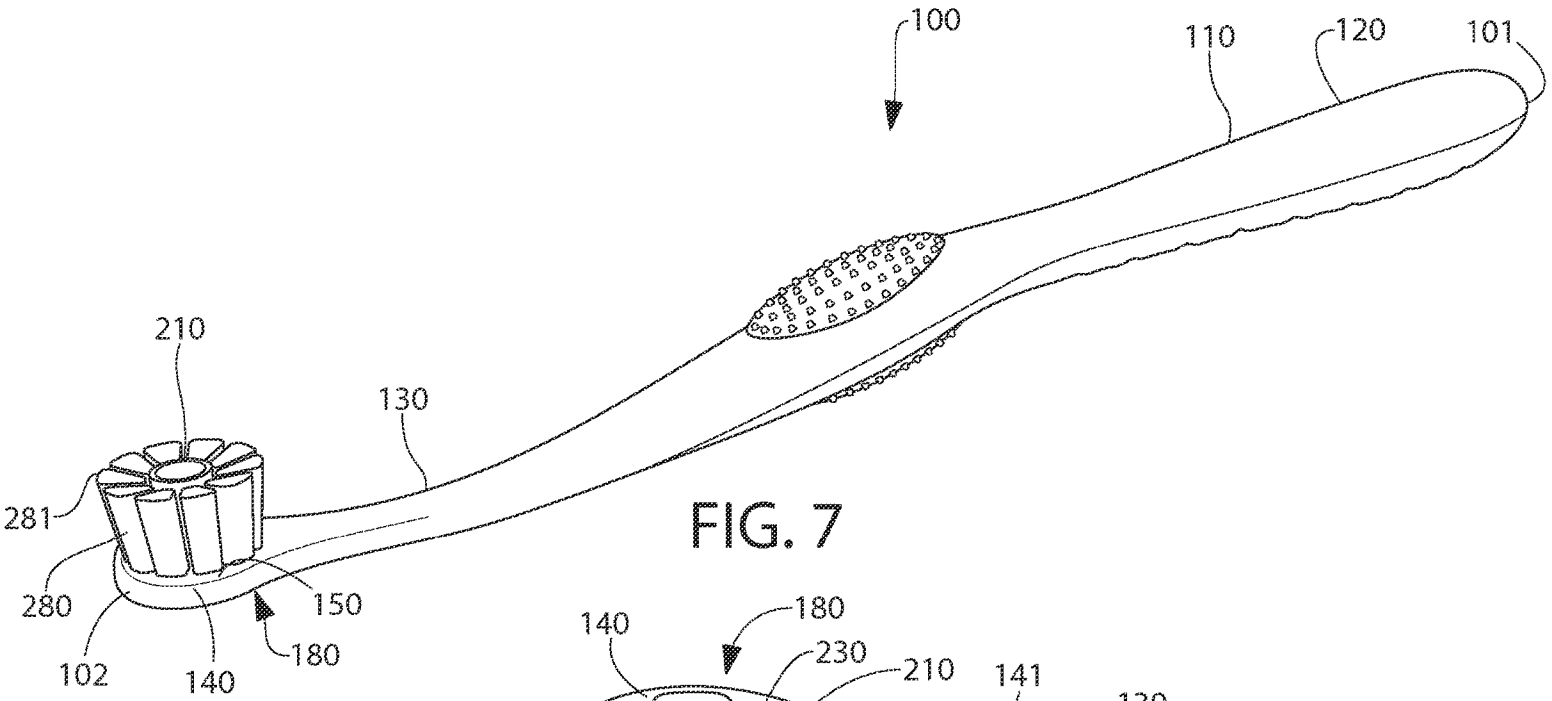
FIG. 7 is a perspective view of an oral care implement according to a third embodiment of the present invention.
Figure 8:
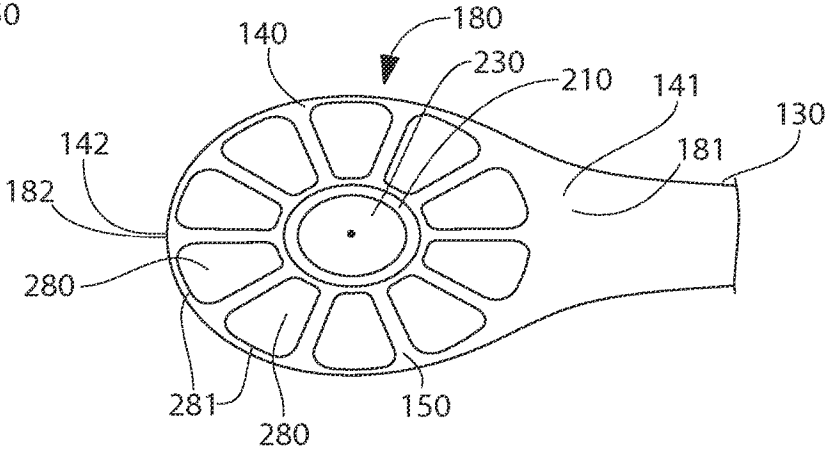
FIG. 8 is an enlarged plan view of a head of the implement of FIG. 7.

A third embodiment of the present invention is shown in FIGS. 7 and 8. Like elements shown in FIGS. 5 and 6 are indicated in FIGS. 7 and 8 with the same reference numerals. In the interests of conciseness, the elements common to the two embodiments will not be described in detail again with reference to FIGS. 7 and 8. All of the above-described possible variations to the first and second embodiments are equally applicable to the third embodiment.

The head 180 of the implement 100 of the third embodiment has a substantially elliptical outer shape in plan view. The head 180 includes only one group 210 of non-parallel tooth cleaning elements 220. The tooth cleaning elements 220 together define therebetween a cavity 230 that has the shape of an elliptical cone. The group 210 is disposed on the head 180 with the cavity 230 substantially coaxial with the elliptical outer shape of the head 180.

Surrounding the group 210 is a plurality of wedge-shaped cleaning elements 280, each of which has a wedge shape in plan view. In some embodiments each of the wedge-shaped cleaning elements 280 is an elastomeric component. However, in the present embodiment, each wedge-shaped cleaning element 280 comprises a group of bristles, wherein each of the bristles has a distal end furthest from the first surface 183 of the head 180, and wherein the distal ends of the bristles together define a sloped distal end 281 of the wedge-shaped cleaning element 280 that has a peak furthest from the centre of the cavity 230. The distal ends of the bristles themselves may be any shape, including flat, rounded or tapered.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the scope of the invention should be construed broadly as set forth in the appended claims.

What is claimed is:

1. An oral care implement, comprising:

a head having a first surface; and a group of non-parallel tooth cleaning elements extending from the first surface of the head;

wherein the tooth cleaning elements together define therebetween a conically-shaped cavity;

wherein the tooth cleaning elements together define a wall around the cavity having a circumferentially continuous wall structure free of gaps therein, the wall having a proximal end adjacent the first surface of the head and a distal end distal from the first surface of the head, the distal end of the wall being defined by distal ends of a plurality of the tooth cleaning elements;

wherein a thickness of the wall measured from an interior side of the wall facing the cavity to an opposite exterior side of the wall is less at the distal end of the wall than at the proximal end of the wall and continuously tapers from the proximal end of the wall to the distal end of the wall;

wherein the head has a hole therein, and wherein the group of non-parallel tooth cleaning elements extends from within the hole;

wherein the head comprises a member, the hole comprises a passage extending through the member, and the tooth cleaning elements extend through the passage so that respective first portions of the tooth cleaning elements are disposed on a first side of the member and respective second portions of the tooth cleaning elements are disposed on a second side of the member;

wherein the tooth cleaning elements of the group are fused together on the second side of the member;

wherein the cavity extends from within the hole in the head to the distal end of the wall.

2. The oral care implement of claim 1, wherein the cavity has an apex within the hole.

3. The oral care implement of claim 1, wherein plural tooth cleaning elements of the group are in contact with one another thereby forming an apex of the cavity.

4. The oral care implement of claim 1, wherein, on a plane parallel to the first surface of the head the thickness of the wall is substantially constant around a full perimeter of the cavity.

5. The oral care implement of claim 1, wherein the distal end of the wall has a substantially linear side profile.

6. The oral care implement of claim 1, wherein the head has a second surface comprising a soft tissue cleaner.

7. The oral care implement of claim 1, wherein some or all of the group of tooth cleaning elements are tapered bristles.

8. The oral care implement of claim 1, wherein the cavity has the shape of one of a full cone, a truncated cone, a right cone, a circular cone, an elliptical cone, or a pyramid.

9. The oral care implement of claim 1, wherein the cavity has an opening defined by distal ends of a plurality of the tooth cleaning elements, and wherein the cavity reduces in cross-sectional area as distance into the cavity from the opening increases.

10. An oral care implement, comprising:

a head having a hole therein, the hole having an axis; and a group of non-parallel tooth cleaning elements extending from within the hole, each tooth cleaning element of the group of tooth cleaning elements having a longitudinal axis, the tooth cleaning elements together defining a continuous circumferentially-extending wall free of gaps therein and forming therebetween a conically-shaped cavity; and wherein the tooth cleaning elements comprise an inner group and an outer group, the inner group forming an inner surface of the wall adjacent the cavity and the outer group forming an outer surface of the wall, the longitudinal axes of the inner group of tooth cleaning elements arranged at a first angle with respect to the axis of the hole and the longitudinal axes of the outer group of tooth cleaning elements arranged at a second angle with respect to the axis of the hole, the first angle being greater than the second angle.

11. The oral care implement of claim 10, wherein the cavity has an apex within the hole.

12. The oral care implement of claim 10, wherein plural tooth cleaning elements of the group are in contact with one another thereby forming an apex of the cavity.

13. The oral care implement of claim 10, wherein the tooth cleaning elements together define a wall around the cavity, the wall having a proximal end adjacent a first surface of the head from which the group of non-parallel tooth cleaning elements extends, wherein the distal end is defined by distal ends of a plurality of the tooth cleaning elements.

14. The oral care implement of claim 13, wherein a thickness of the wall measured from an interior side of the wall facing the cavity to an opposite exterior side of the wall is less at the distal end of the wall than at the proximal end of the wall.

15. The oral care implement of claim 10, wherein the hole comprises a tapered hole.

16. The oral care implement of claim 10, wherein the head comprises a member, the hole comprises a passage extending through the member, and the tooth cleaning elements extend through the passage so that respective first portions of the tooth cleaning elements are disposed on a first side of the member and respective second portions of the tooth cleaning elements are disposed on a second side of the member.

17. The oral care implement of claim 16, wherein the cavity has an apex on the second side of the member.

18. The oral care implement of claim 16, wherein the cavity has an apex in the passage.

19. The oral care implement of claim 16, wherein the tooth cleaning elements of the group are fused together on the second side of the member.

20. The oral care implement of claim 10, wherein a thickness of the wall varies continuously with increasing distance from the head.

21. An oral care implement, comprising:

a head having a hole therein, the hole having an axis; and a group of non-parallel tooth cleaning elements extending from within the hole, each tooth cleaning element of the group of cleaning elements having a proximal end adjacent the head, a distal end distal from the head, and a longitudinal axis extending from the proximal end to the distal end the tooth cleaning elements together defining a circumferentially continuous wall free of gaps therein and forming therebetween a conically-shaped cavity;

wherein the cavity extends from a proximal end of the wall adjacent a first surface of the head to a distal end of the wall distal from the first surface of the head; and wherein the tooth cleaning elements comprise an inner group and an outer group, the inner group forming an inner surface of the wall adjacent the cavity and the outer group forming an outer surface of the wall, the longitudinal axes of the inner group of tooth cleaning elements arranged at a first angle with respect to the axis of the hole and the longitudinal axes of the outer group of tooth cleaning elements arranged at a second angle with respect to the axis of the hole, the first angle being greater than the second angle.

22. The oral care implement of claim 21, wherein plural tooth cleaning elements of the group are in contact with one another thereby forming the apex of the cavity.

23. The oral care implement of claim 21, wherein the hole has a cross-sectional area orthogonal to the axis, and wherein the cross-sectional area of the hole varies along the axis.

* * * * *